US009551554B2

(12) United States Patent
Pienkos et al.

(10) Patent No.: US 9,551,554 B2
(45) Date of Patent: Jan. 24, 2017

(54) CRYOGENICALLY GENERATED COMPRESSED GAS CORE PROJECTILES AND RELATED METHODS THEREOF

(71) Applicant: The United States of America as represented by the Secretary of the Navy, Washington, DC (US)

(72) Inventors: Jules Pienkos, Bloomington, IN (US); Bart Gilliatt, Bloomfield, IN (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/821,909

(22) Filed: Aug. 10, 2015

(65) Prior Publication Data

US 2016/0282096 A1 Sep. 29, 2016

Related U.S. Application Data

(60) Provisional application No. 62/137,468, filed on Mar. 24, 2015.

(51) Int. Cl.
*F42B 12/34* (2006.01)
*F42B 30/02* (2006.01)
*F42B 33/00* (2006.01)

(52) U.S. Cl.
CPC ..... *F42B 12/34* (2013.01); *F42B 30/02* (2013.01); *F42B 33/00* (2013.01)

(58) Field of Classification Search
CPC ..... F42B 12/00; F42B 12/02; F42B 12/34; F42B 12/36; F42B 12/46; F42B 12/50; F42B 30/00; F42B 30/02; F42B 30/003; F42B 99/00
USPC ..... 102/501, 502, 507, 508, 509
See application file for complete search history.

(56) References Cited

U.S. PATENT DOCUMENTS 3,121,392 A * 2/1964 Economon ..... B64G 1/007 102/381
3,913,487 A * 10/1975 Scherr ..... F42B 10/38 102/501
3,921,614 A * 11/1975 Fogelgren ..... F42B 5/02 102/448
6,401,591 B1 * 6/2002 Ross ..... F42B 33/06 102/399
6,543,365 B1 * 4/2003 Vasel ..... F41B 11/57 102/367

(Continued)

*Primary Examiner* — James S Bergin
(74) *Attorney, Agent, or Firm* — Christopher A. Monsey

(57) ABSTRACT

Exemplary projectiles and methods associated therewith including embodiments formed with an internal cavity adapted to receive and retain a cryogenic material into said cavity and then generate a first internal gas upon thermal equalization with said projectile as well as a first internal gas pressure within said cavity. Exemplary embodiments include a structure adapted for maintaining structural integrity after generation of the first internal gas pressure and a second internal gas pressure that is created upon the firing of the projectile. In some embodiments, the second internal gas pressure is more than twice the first internal gas pressure. Some embodiments are adapted with a portion of the projectile formed for displacing away or laterally from an axis formed through a longitudinal center of the projectile upon an impact from striking an object after firing based in part on internal gas pressure and an impact at cavity wall section rupture zones.

53 Claims, 6 Drawing Sheets

(56) References Cited

U.S. PATENT DOCUMENTS

| | | | | |
|---|---|---|---|---|
| 7,173,540 | B2 * | 2/2007 | Daigle | F42B 8/26 102/209 |
| 7,231,874 | B2 * | 6/2007 | Rastegar | F41H 11/02 102/207 |
| 7,373,887 | B2 * | 5/2008 | Jackson | F42B 12/34 102/510 |
| 7,380,502 | B2 * | 6/2008 | Emary | F42B 12/34 102/506 |
| 7,478,680 | B2 * | 1/2009 | Sridharan | A62C 3/025 102/368 |
| 8,413,587 | B2 | 4/2013 | Emary | |

* cited by examiner

CRYOGENICALLY GENERATED COMPRESSED GAS CORE PROJECTILES AND RELATED METHODS THEREOF

CROSS-REFERENCE TO RELATED APPLICATIONS

The present application claims priority to U.S. Provisional Patent Application Ser. No. 62/137,468, filed Mar. 24, 2015, entitled "COMPRESSED GAS CORE PROJECTILE," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,117) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to a field of projectiles in particular the area of generating improved results from projectiles in terms of increasing interaction of a projectile with a target while increasing ballistic performance to include longer range and improved aerodynamics.

One objective of this invention includes providing improved projectiles and production processes. An exemplary projectile, possibly but not limited to a bullet type, can include a compressed gas core instead of a standard solid body or hollow point designs currently available. Embodiments of an improved projectile will be able to increase energy transfer once entering the target body that should increase the lethality to the target, improve stopping power, and enhance safety of non-target entities.

An exemplary disclosure could be used for any variety of projectiles where a compressed gas core would be an improvement. In one embodiment, an exemplary process can focus on use with a projectile such as a bullet. A bullet can be viewed as a projectile portion of an ammunition round and not the entire ammunition round such as shown in FIG. 1. However, bullet and projectile may be used interchangeably for with respect to at least some embodiments. An embodiment of the invention can include a projectile with a compressed gas core.

Various bullet designs exist including hollow point bullets. Upon entering a body, hollow point bullets will flatten and expand outward creating an expanded area at the front of the bullet. This expanded area creates greater drag on the bullet and thus decelerates a bullet faster than a non-hollow point bullet. This deceleration results in a design that is less likely to leave a target and immediately strike or, by ricochet, enter another non-targeted body. Additionally, a hollow point can be more likely to cause greater damage to the target body as the greater, expanded area imparts more energy and cuts a larger path through the target body.

An exemplary projectile with a compressed gas core invention provides an improvement over hollow point bullets. A different projectile design can be accommodated that provides an ability to increase aerodynamic performance of the projectile while increasing energy transfer by altering how deformation of the projectile occurs after entry into a target. One aspect of the invention can include providing high pressure gas in a cavity within the projectile that applies force to sides of the projectile to increase or alter surface area with respect to the terminal path. High pressure in the cavity will force the bullet to quickly expand and deliver all of its kinetic energy in a shorter distance rather than penetrate through the target. There are other potential improvements this design could bring forward such as greater accuracy due to improved flight dynamics of the tip of the bullet. An exemplary bullet will deliver more energy and stopping power because of increased speed. An exemplary bullet will have optimized mass design capability and can "carry" more energy and stopping power.

Generally, exemplary projectiles and methods associated therewith are provided including exemplary projectiles and methods associated therewith including embodiments formed with an internal cavity adapted to receive and retain a cryogenic material into said cavity and then generate a first internal gas upon thermal equalization with said projectile as well as a first internal gas pressure within said cavity. Exemplary embodiments can include a structure adapted for maintaining structural integrity after generation of the first internal gas pressure and a second internal gas pressure that is created upon the firing of the projectile. In some embodiments, the second internal gas pressure is more than twice the first internal gas pressure. Some embodiments can be adapted with a portion of the projectile formed for displacing away or laterally from an axis formed through a longitudinal center of the projectile upon an impact from striking an object after firing based in part on internal gas pressure and an impact at cavity wall section rupture zones.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

The present disclosure relates to structures and methods for increasing a projectile's ability to stop and/or transfer kinetic energy to an object after impact. More particularly, examples of embodiments discussed in the present disclosure include design structures in combination with cryogenic material used to generate compressed gas enclosed within a body of a projectile to increase a surface area of a projectile after impacting an object.

As some background, a form of a forward end of an exemplary projectile can be described as an ogival curve (generated by revolving an arc of a circle about a chord) that is aerodynamically efficient. A variety of ogives structures can be defined or described including by reference to Spitzer, round, flat, wadcutter, hollow point (e.g. with an open nose), etc. shape descriptions. Behind the ogive section, an example projectile can transition to a body portion that can be cylindrical with the exception in some cases of a bourrelet, which can be slightly larger than the diameter of the projectile's body to reduce surface area (and thus friction) of the projectile contacting a gun bore. Near an aft end or base of an exemplary projectile, a rotating band can be included, which is actually larger than gun bore diameter to engage the bore's rifling grooves and seal the bore while supporting the aft end of the projectile. Aft of the rotating band the cylindrical shape may continue to the base of the projectile or it may be tapered to a "boat tail." In some cases, a projectile can have a nose tip section referred to as a "meplat" that is a section on a far end or tip of a nose that can take a different shape, e.g., flat shape, than projectile structure aft of the meplat towards the projectile's base.

A more elongated curved or pointed ogive, e.g., a Spitzer bullet nose or ogive, sometimes referred to as a spire point bullet, can provide for aerodynamic bullet designs that can give a higher degree of accuracy and kinetic efficiency, especially at extended ranges. To achieve such desirable advantages, a projectile must minimize air resistance in flight. Bullets with a lower drag coefficient (Cd) decelerate less rapidly. A low drag coefficient flattens the projectile's trajectory somewhat at long ranges and also markedly decreases the lateral drift caused by crosswinds. The higher impact velocity of bullets with high ballistic coefficients means they retain more kinetic energy. The name "Spitzer" can refer in some cases to an anglicized form of the German word Spitzgeschoss, literally meaning "pointy bullet" and refers to a class or category of projectiles with nose, shape, or characteristics of interest.

Figure 1:
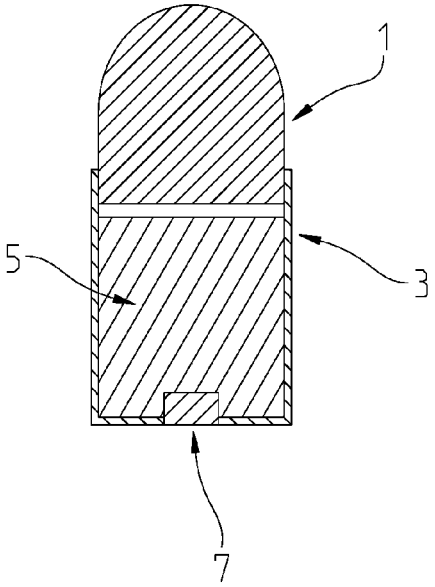
Fig. 1 PRIOR ART
FIG. 1 shows a cross-sectional view of a simplified exemplary projectile and case with propellant and a primer.
Figure 2A:
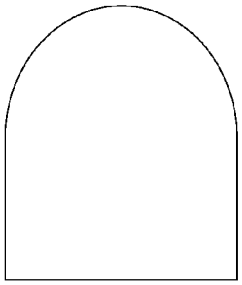
FIGS. 2A, 2B, 2C and 2D show simplified pairs of views including an external view (left) and cut-out view (right) of an exemplary compressed gas core projectile.
Figure 2B:
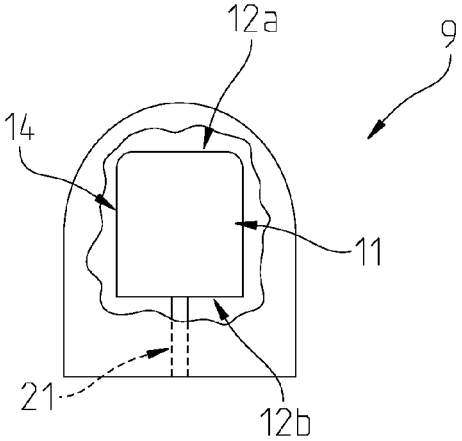
Figure 2C:
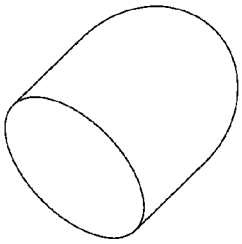
Figure 2D:
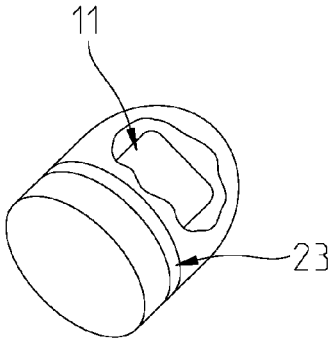

As shown in FIG. 1, an exemplary generic simplified projectile 1 is shown. The simplified projectile 1 includes a case 3 that provides a containing function to hold a propellant 5 and a primer 7. The generic FIG. 1 projectile 1 is shown as having an ogive with a round nose and a flat tail. However, embodiments of the invention can include a Spitzer nose or a pointier ogive section as well as a variety of round nose structures or other structures.

Figure 3A:
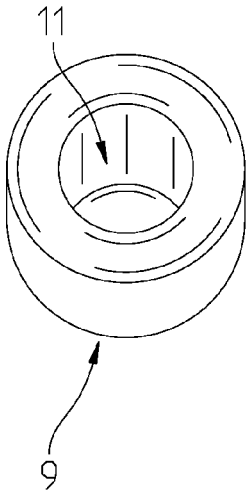
FIGS. 3A, 3B and 3C show a set of simplified views of an exemplary compressed gas core section of an exemplary compressed gas core projectile before, during, and after filling and sealing of the compressed gas core's cavity with cryogenic material.
Figure 3B:
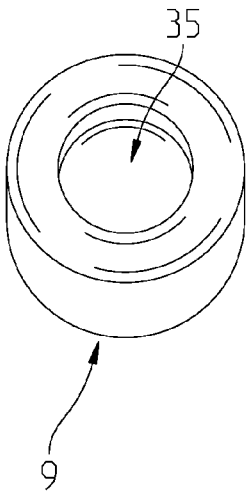
Figure 3C:
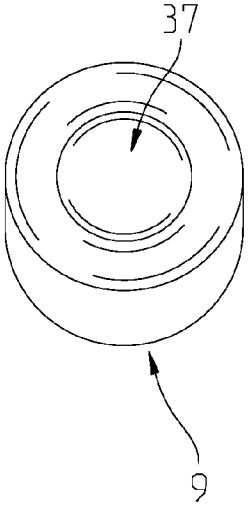
Figure 4B:
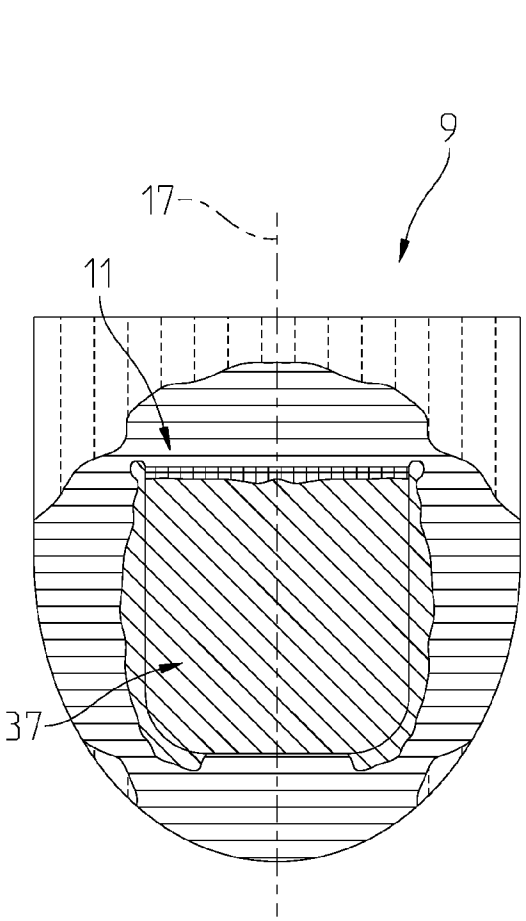
FIGS. 4A and 4B show perspective external and cross-sectional views of a static structural graphical depiction of an exemplary projectile in accordance with an embodiment of the invention showing maximum shear stress in different sections of the exemplary projectile under compressed gas pressure.
Figure 4A:
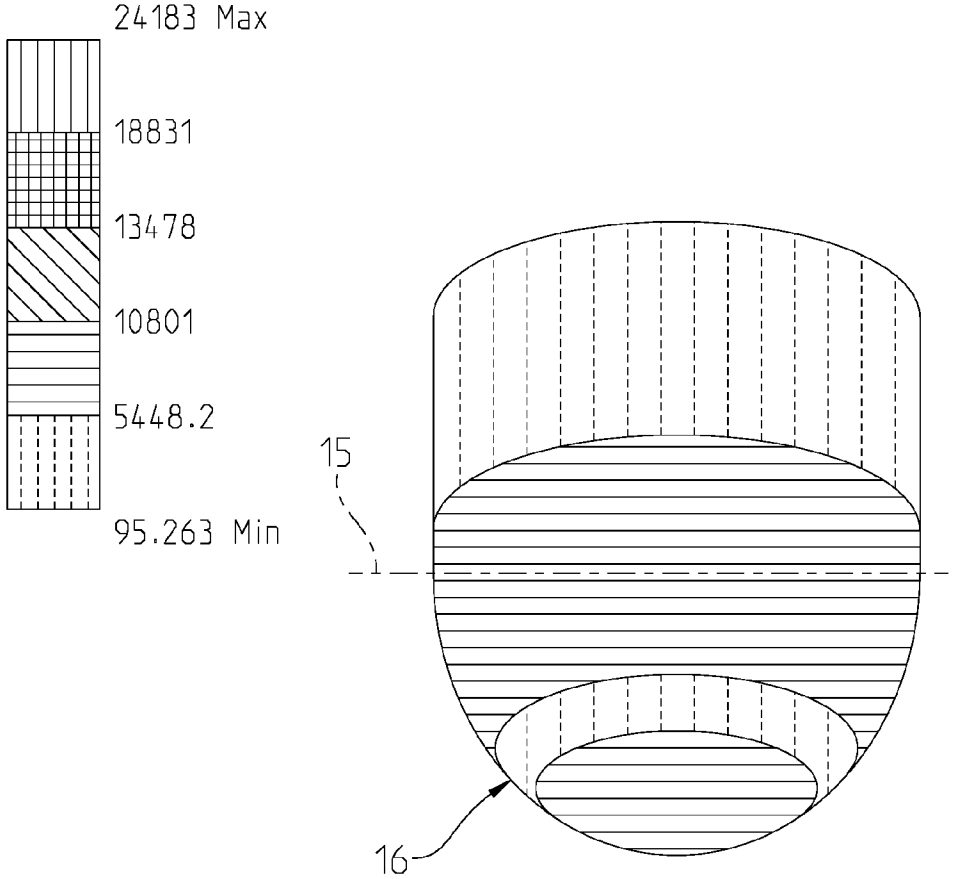

FIGS. 2A, 2B, 2C and 2D show a simplified view of an embodiment of the present invention that shows an external view of an exemplary projectile 9 embodiment. A hollow cavity or compressed gas core or cavity 11 is also shown in a cut-out view (right) of one embodiment. In one embodiment, the compressed gas core or cavity 11, defined by two terminal ends 12*a* and 12*b* and an inner face 14, can be filled with liquid nitrogen and sealed by means of a plug or sealing structure 21 or a threaded or compression fitted section 23;

FIGS. 3A, 3B, and 3C show a generic exemplary embodiment of the present invention at various stages of trapping cryogenic liquids or solids in a projectile. An empty cavity or compressed gas core or cavity 11, within a mass of the projectile 9, will be initially formed so that the cryogenic material 35 can be added prior to the compressed gas core or cavity being sealed 37 and the intended shape of the projectile is completed;

FIGS. 4A and 4B show perspective external and cross-sectional views of a static structural graphical depiction of an exemplary projectile 9 in accordance with an embodiment of the invention showing maximum shear stress in different sections of the exemplary projectile under compressed gas pressure. In particular, FIGS. 4A and 4B show stress arising from post-cryogenic liquid expansion into compressed gas 37 within core or cavity 11 under storage conditions. In one embodiment, the projectile 9 can be formed with a simple ogive projectile profile, e.g., rounded, and comprising copper. In one embodiment, an exemplary projectile 9 can be dimensioned for a 9 mm outer geometry dimension with a maximum wall thickness of ~2 mm, a minimum wall thickness of ~1.3 mm, a total mass ~4.0 grams, a core or cavity pressure of ~9,500 psi (e.g., initial max pressure ~10,000 psi), and a stress maximum under storage conditions of 24 k psi. The FIGS. 4A and 4B embodiment is shown with an ogive transition plane or line 15 that is located approximately at a transition point between a start of curvature forming the projectile's 9 nose or ogive section and a body section that has a greater diameter than the nose or ogive section. The FIGS. 4A and 4B projectile 9 can also have a center axis 17 running from a center of the nose or ogive section through a center of a base of the projectile. In one embodiment, e.g., such as shown in FIGS. 4A and 4B, the core or cavity 11 containing pressurized gas created from cryogenic material thermal equalization within the core or cavity 11 is positioned so that it has the ogive transition 15 axis running through a center section of the core or cavity 11. In FIGS. 4A and 4B examples, the projectile's 9 ogive or nose section between the core or cavity 11 and the projectile's 9 nose tip or end is formed having shorter length than an aft section of the projectile formed between an aft end of the core or cavity 11 and the base or aft end of the projectile. The core or cavity 11 section can be formed so that part of the core or cavity 11 section is formed within the ogive section and a remaining part is formed within the projectile's 9 base aft of the ogive section. In one embodiment, the core or cavity 11 section can be formed such that the core or cavity 11 section extends past the ogive transition more than half way through the ogive section. The core or cavity 11 section can also be formed such that it extends at least fifty percent of a radius defined from the projectile's 9 center axis 17 to a plane defined by an outer surface of the projectile's body next to the ogive transition line 15. The exemplary projectile 9 can also be formed such that edge sections of both forward and aft or rear side sections of the core or cavity 11 have a section between a forward section of the projectile's 9 core or cavity 11 has a higher shear stress due to the compressed gas 37 within the core or cavity than a middle section between the forward and aft or rear sections of the projectile's 9 core or cavity 11. In one example, the higher shear stress on the forward and aft or rear side sections are more than fifty percent higher than in the middle section of the sides of the core or cavity 11. In some embodiments, a rupture zone 16 can be formed into a portion of a front end, e.g., the ogive, of the projectile 9 which forms a wall section between an outer surface of the front end and a forward end of the core or cavity 11 such that the projectile 9 has a cavity wall minimum thickness. This rupture zone 16 can be designed such that the projectile 9 is more likely to lose structural integrity at this rupture zone 16 upon onset of impact and thus begin lateral or semi-lateral expansion at or around this rupture zone 16 at least in part due to internal gas pressure.

Figure 5:
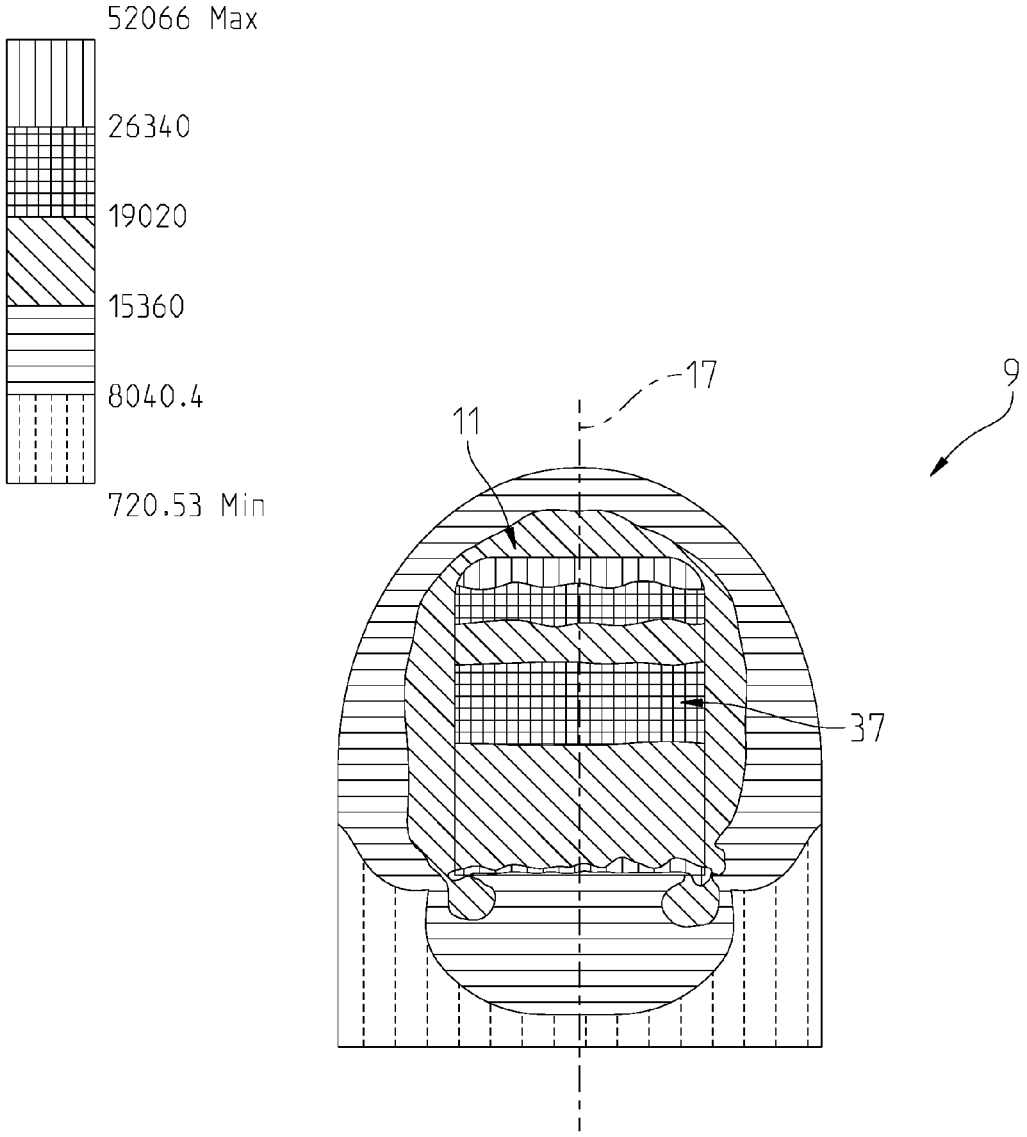
FIG. 5 shows a side cross-sectional view of a static structural graphical depiction of an exemplary projectile in accordance with an embodiment of the invention showing stress in different sections of the exemplary projectile under different types of stress.

FIG. 5 shows a side cross-sectional view of a static structural graphical depiction of an exemplary projectile 9 in accordance with an embodiment of the invention showing maximum shear stress in different sections of the exemplary projectile 9 under compressed gas pressure and firing stress. Again, projectile 9 is shown having a center axis 17 running from the center of the nose or ogive section through a center of a base of the projectile. Compressed gas 37 created from post-cryogenic liquid expansion is shown within the core or cavity 11 created under manufacturing, storage conditions, or out of storage but before firing. In this example, a von-Mises stress simulation result is shown displaying multi-axis stress values (e.g., energy distortion of structural elements) associated with the internal cavity wall sections and other sections. In this example, this figure shows stress values associated with yielding of projectile materials under particular loading conditions (e.g., firing or launching). An exemplary design must ensure that the exemplary projectile and propellant combination produces less stress than an ultimate tensile strength (UTS) of the exemplary projectile's material and structure so as to ensure structural integrity during firing or launching. In particular, an exemplary embodiment can be formed to withstand more than a maximum stress during firing of 52 k psi so the projectile 9 maintains structural integrity during firing but loses integrity after impact. The FIG. 5 embodiment can be formed to have transient structural stress (e.g., the projectile is fired out a weapon to launch the projectile) on both ends of the core or cavity 11 which more than fifty percent higher than transient stress at a center section of the sides of the core or cavity 11.

Figure 6:
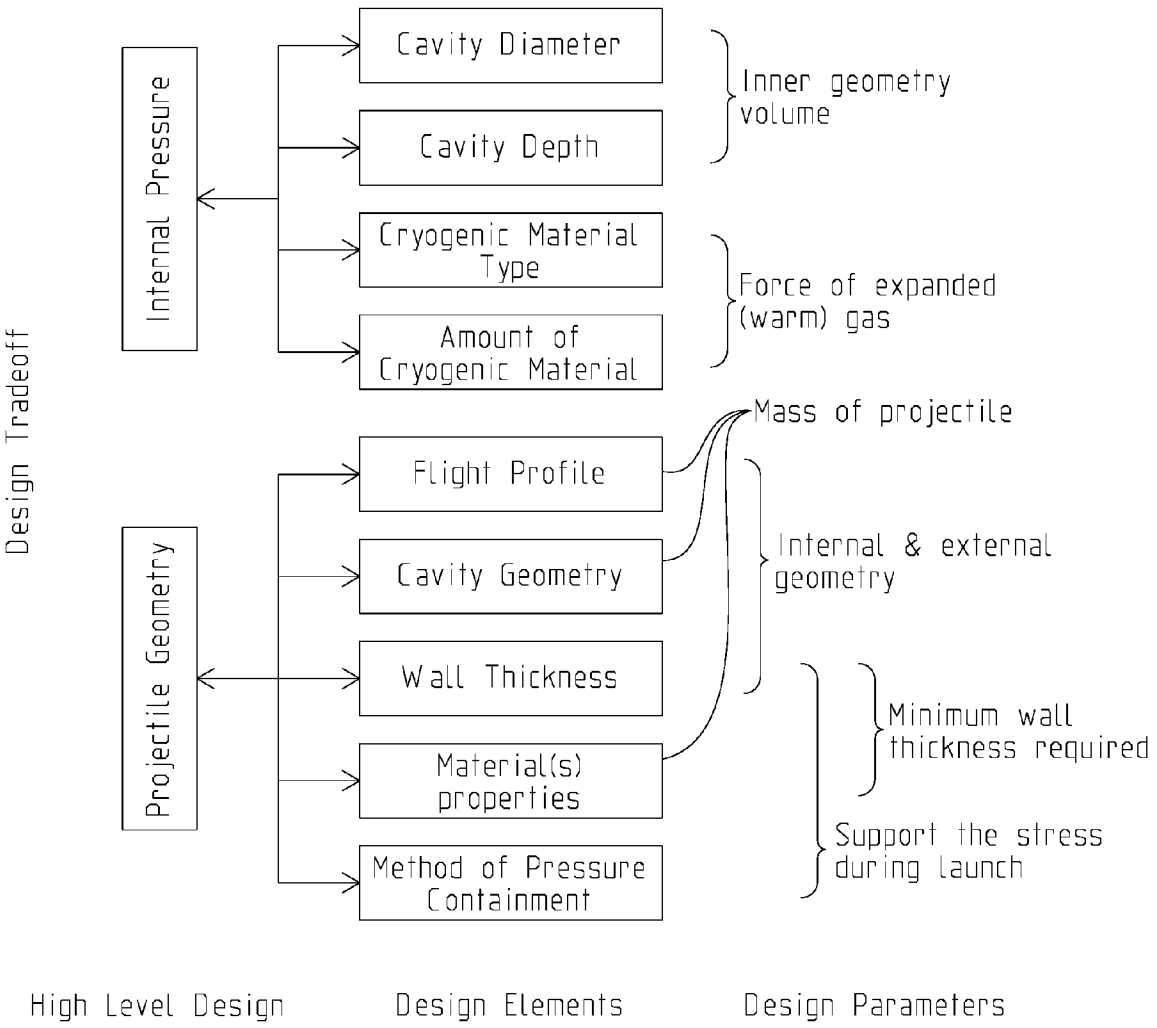
FIG. 6 shows an exemplary design process tradeoff factors with exemplary high-level design, design elements, and design parameters.

FIG. 6 shows an exemplary design process's tradeoff factors with exemplary high-level design, design elements, and design parameters. Two groups of high level design elements are provided including projectile geometry and internal pressure. Exemplary internal pressure high-level design elements include design elements such as cavity diameter, cavity depth, cryogenic material type, and amount of cryogenic material. Exemplary projectile geometry high-level design elements include design elements such as flight profile, cavity geometry, wall thickness, material(s) properties, and pressure containment design aspects. Exemplary design parameters associated with internal pressure high-level design and associated design elements include inner geometry volume and force of expanded (warmed) gas from cryogenic material. Exemplary design parameters associated with projectile geometry high-level design and associated design elements include mass of projectile, internal & external geometry, minimum required wall thickness to maintain structural integrity until impact with a target as well as structure required to deform in a desired manner upon impact in combination with internal pressure, and structure required to support firing stress during launch.

Figure 7:
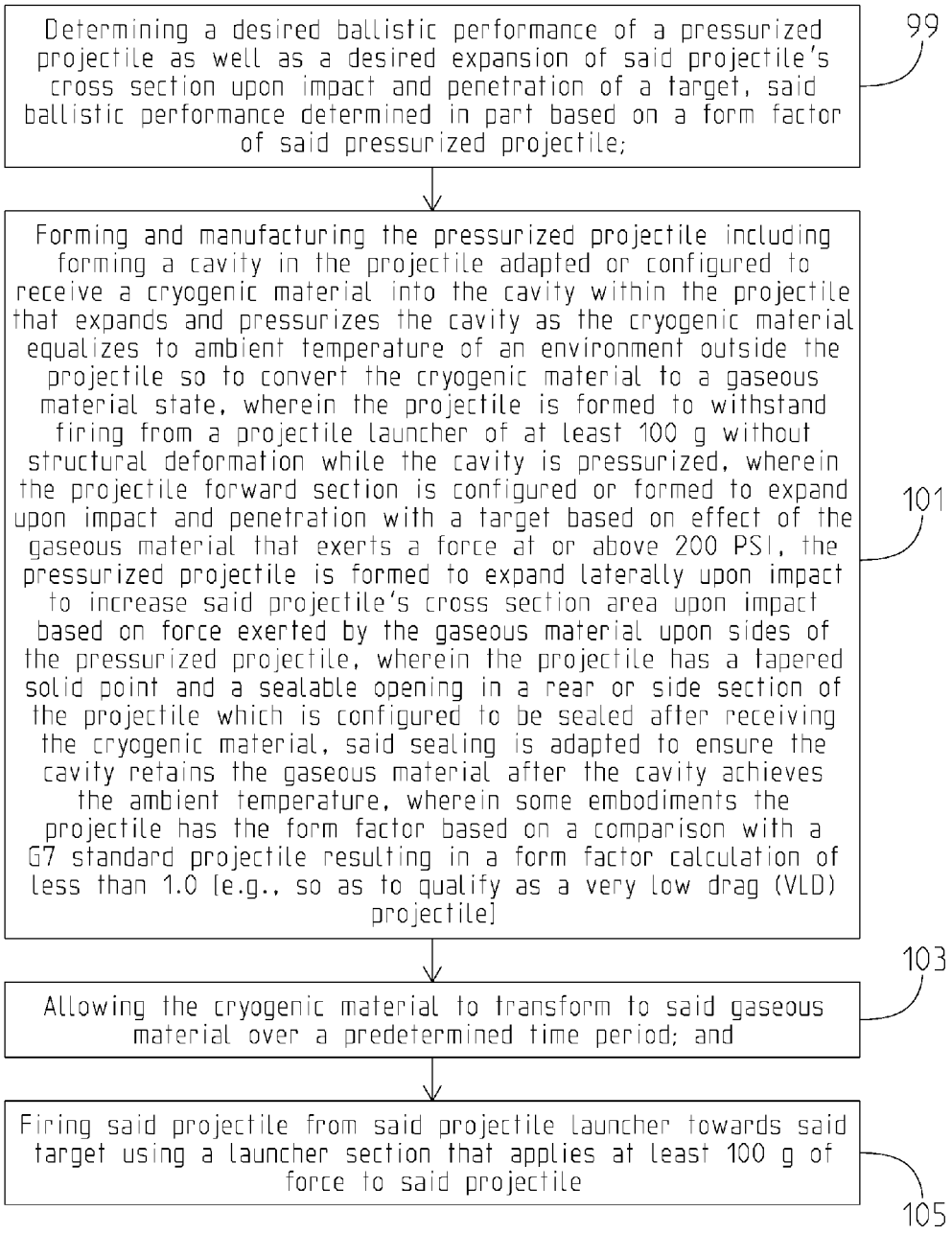
FIG. 7 shows an exemplary method of manufacturing in accordance with one embodiment of the invention.

Referring to FIG. 7, an exemplary process to design, manufacture, and use an exemplary embodiment of the invention is provided. At Step 99: Determining a desired ballistic performance of a pressurized projectile as well as a desired expansion of the projectile's cross section upon impact and penetration of a target. Projectile ballistic performance can be determined in part based on a form factor of the pressurized projectile as it influences precision or other ballistic performance. At Step 101: Forming and manufacturing said pressurized projectile including forming a cavity adapted or configured to receive a cryogenic material, e.g., liquid nitrogen, into said cavity within the projectile that expands and pressurizes the cavity as the cryogenic material equalizes to ambient temperature of an environment outside the projectile so to convert said cryogenic material to a gaseous material state comprising a gaseous material, wherein the projectile is formed to withstand firing from a projectile launcher of at least 100 g while said cavity is pressurized, wherein the projectile forward section is configured or formed to expand upon impact and penetration with a target based on said gaseous material that exerts a force at or above 200 psi, said pressurized projectile is formed to expand laterally upon impact to increase the projectile's cross-sectional area upon impact based in part on force exerted by the gaseous material upon sections or sides of the pressurized projectile. An exemplary projectile can have a tapered or rounded solid point forward of the cavity and a sealable opening in a rear or side section of the projectile which can be configured to be sealed after receiving the cryogenic material. Such sealing can be adapted to ensure the cavity retains post-cryogenic state gaseous material after it achieves equilibrium with ambient temperature external to the exemplary projectile.

One example projectile's form factor can be determined based on a comparison with a G7 standard projectile resulting in a form factor calculation of less than 1.0 so as to qualify as a very low drag (VLD) projectile. Other form factors are also usable with this invention to achieve desired ballistics performance. Dimensions or structures of the projectile can be designed such as discussed or shown with respect to, e.g., FIG. 4A, 4B or 5.

At step 103: Allowing the cryogenic material to transform to the gaseous material over a predetermined time period. At Step 105: Firing the projectile from the projectile launcher towards said target using a launcher section that applies at least 100 g of force to said projectile.

An alternative embodiment can include a variant where the projectile body's nose or front of its ogive extending into the projectile is formed with a hollow point or concave opening.

Although the invention has been described in detail with reference to certain preferred embodiments, variations and modifications exist within the spirit and scope of the invention as described and defined in the following claims.

The invention claimed is:

1. A cryogenically pressurizable projectile adapted to at least partially laterally expand upon impact comprising:

an elongated body comprising a first, second, and third section, said second section is formed between said first and third sections, said first and third sections respectively have a first end and a second end section where said first end of said first section includes a forward tip of the projectile and said second end includes an aft end of said projectile on an opposing side of the elongated body from the forward tip, the elongated body having a first axis running through a center section of said first and second end sections as well as through a longitudinal center of said first, second and third sections, wherein said first section comprises an ogive shape rotated around said first axis;

an internal cavity disposed within said body with a side wall section surrounding and spaced apart from said first axis, wherein said internal cavity further is defined by a first and second cavity end section that are on opposing ends of said internal cavity adjacent to said side wall section, wherein said internal cavity is formed extending into said first and third sections and through said second section within said elongated body;

an internal cavity fill structure disposed through said second end section through a portion of said third section into said internal cavity; and a fill structure plug, screw, or closure section disposed within said fill structure adapted to receive and retain a cryogenic material into said internal cavity and retain structural integrity and remain fixed with respect to said second end section after said cryogenic materials generate a first internal gas upon thermal equalization within said projectile.

2. The projectile as in claim 1, wherein said first internal gas pressure results in shear stress of at least 24,000 psi on a section of wall of the internal cavity.

3. The projectile as in claim 1, wherein said projectile body comprises copper.

4. The projectile as in claim 1, wherein said ogive is formed having a rounded section.

5. The projectile as in claim 1, wherein said ogive is formed having a conical section.

6. The projectile as in claim 1, wherein said ogive is further formed with a meplat section defining said first end section.

7. The projectile as in claim 1, wherein said second end section is formed with a boattail form.

8. The projectile as in claim 1, wherein said elongated body's first section surrounding said cavity is formed having a solid structure.

9. The projectile as in claim 1, wherein said elongated body's first section at and between said forward tip and said internal cavity is formed with a solid structure.

10. The projectile as in claim 1, wherein said elongated body's first section at said first end section including said forward tip extending along said first axis comprises a hollow point or concave opening formed into said first end section.

11. The projectile as in claim 1, wherein said first section is formed with a wall section having a minimum thickness or rupture zone at or adjacent to a circular area of said first section parallel with and extending a first distance away from with said first cavity end section.

12. The projectile as in claim 1, further comprising a cryogenic material disposed within said cavity.

13. The projectile as in claim 1, further comprising a gas at a pressure of at least 200 psi disposed within said cavity.

14. A projectile comprising:

an elongated body including an internal cavity disposed extending partially within in an ogive section and a section aft of the ogive section adapted to receive and retain a cryogenic material into said cavity within the projectile that expands and pressurizes the cavity as the cryogenic material equalizes to ambient temperature of an environment outside the projectile so to convert said cryogenic material to a gaseous material state comprising a gaseous material, the elongated body further is formed with a fill structure and fill sealing structure, wherein the fill structure is formed through a section of said elongated body, said fill sealing structure configured to selectively insert and remain fixed within the fill structure after said cryogenic material is placed into said internal cavity.

15. A projectile as in claim 14, wherein the projectile's ogive section between the internal cavity and a tip of the ogive is formed having shorter length than an opposing end section of the projectile formed between an end of the cavity and a base end of the projectile that is on an opposing end of the body from the tip of the ogive.

16. A projectile as in claim 14, wherein the internal cavity is formed so that part of the internal cavity section is formed within the ogive section and a remaining part is formed within the projectile aft of the ogive section.

17. A projectile as in claim 14, wherein the cavity section is formed such that it extends at least fifty percent of a radius line defined from a longitudinal center axis of the projectile to a plane defined by an outer surface of the projectile's body adjacent to the ogive section.

18. A projectile as in claim 14, wherein wall sections of both forward and aft or rear side sections of the cavity's walls have a higher shear stress arising from the gaseous material within the core or cavity than a middle wall section between the forward and aft or rear sections of the projectile's cavity.

19. A projectile as in claim 18, wherein the wall sections of both forward and aft or rear side sections of the cavity's walls have more than fifty percent higher said shear stress than in a middle section of the sides of the core or cavity.

20. A projectile as in claim 14, wherein the projectile is formed to maintain structural integrity with respect to the internal cavity and withstand firing from a projectile launcher of at least 100 g while said internal cavity is pressurized.

21. A projectile as in claim 14, further comprising said gaseous material disposed within said cavity, wherein the projectile's ogive and section adjacent to the ogive section are formed with wall thicknesses surrounding or adjacent to the internal cavity formed to displace laterally upon impact and penetration with a target based on said gaseous material that exerts a force on said cavity at or above 200 psi.

22. A projectile as in claim 14, wherein said pressurized projectile is formed to expand laterally upon impact to increase said projectile's cross section area upon impact based on force exerted by said gaseous material upon sides of said pressurized projectile.

23. A projectile as in claim 14, wherein said projectile's ogive has a tapered solid point.

24. A projectile as in claim 14, wherein said fill structure and fill sealing structure comprises a threaded opening and a threaded screw, plug or structure that threadably engages the threaded opening which is configured to be inserted after receiving said cryogenic material.

25. A projectile as in claim 24, wherein said fill sealing structure is adapted to ensure said cavity retains said gaseous material after it achieves said ambient temperature.

26. A projectile as in claim 14, wherein said projectile has said form factor based on a comparison with a G7 standard projectile resulting in a form factor calculation of less than 1.0.

27. A method of manufacturing a cryogenically-pressurized projectile comprising:

providing or manufacturing an elongated body comprising a first, second, and third section, said second section is formed between said first and third sections, said first and third sections respectively have a first end and a second end section where said first end of said first section includes a forward tip of the projectile and said second end includes an aft end of said projectile on an opposing side of the elongated body from the forward tip, the elongated body having a first axis running through a center section of said first and second end sections as well as through a longitudinal center of said first, second and third sections, wherein said first section comprises an ogive shape rotated around said first axis;

forming an internal cavity disposed within said body with a side wall section surrounding and spaced apart from said first axis, wherein said internal cavity further is defined by a first and second cavity end section that are on opposing ends of said internal cavity adjacent to said side wall section, wherein said internal cavity is formed extending into said first and third sections and through said second section within said elongated body;

forming an internal cavity fill structure disposed through said second end section through a portion of said third section into said internal cavity; and providing a fill structure plug, screw, or closure section disposed within said fill structure adapted to receive and retain a cryogenic material into said internal cavity and retain structural integrity and remain fixed with respect to said second end section after said cryogenic materials generate a first internal gas upon thermal equalization within said projectile.

28. A method as in claim 27, wherein said projectile is formed having a first means including a means for maintaining structural integrity after generation of a first internal gas from a cryogenic material disposed within said internal cavity via said internal cavity fill structure, a first internal gas pressure from said first internal gas, and upon firing said projectile that creates a second internal gas pressure created upon said firing of said projectile, wherein said second internal gas pressure is more than twice said first internal gas pressure, wherein said first means further includes at least a portion of said body at or adjacent to said first and second sections are adapted for displacing portions of said first section away from said first axis upon an impact from striking an object after said firing based on at least said first internal gas pressure and said impact.

29. The method as in claim 28, wherein first means comprises said first section formed with a wall section having a minimum thickness or rupture zone at or adjacent to a circular area of said first section parallel with and extending a first distance away from said first cavity end section.

30. A method as in claim 27, wherein said body is formed based on anisotropic material conditions by a manufacturing process comprising coldworking a portion of the body's said material during said process before said cryogenic material is deposited within said internal cavity.

31. A method as in claim 27 wherein said first internal gas pressure creates a shear stress on at least one section of the internal cavity wall of is at least 24,000 psi.

32. A method as in claim 27, wherein said projectile body comprises copper.

33. The method as in claim 27, wherein said ogive is formed having a rounded section.

34. The method as in claim 27, wherein said ogive is formed having a conical section.

35. The method as in claim 27, wherein said ogive is further formed with a meplat section defining said first end section.

36. The method as in claim 27, wherein said second end section is formed with a boattail form.

37. The method as in claim 27, wherein said elongated body's first section surrounding said cavity is formed having a solid structure.

38. The method as in claim 27, wherein said elongated body's first section at and between said forward tip and said internal cavity is formed with a solid structure.

39. The method as in claim 27, wherein said elongated body's first section at said first end section including said forward tip extending along said first axis comprises a hollow point or concave opening formed into said first end section.

40. The projectile as in claim 27, further comprising a cryogenic material disposed within said cavity.

41. The projectile as in claim 27, further comprising a gas at a pressure of at least 200 psi disposed within said cavity.

42. A process associated with a projectile comprising:

providing a pressurized projectile formed with a structure having a predetermined ballistic performance as well as a predetermined expansion of said projectile's cross section upon impact and penetration of a target, said ballistic performance determined in part based on a form factor of said pressurized projectile, including a cavity filled with a gaseous material generated from a cryogenic material disposed in said cavity equalized to ambient temperature of an environment outside the projectile, wherein the projectile is formed to withstand firing from a projectile launcher of at least 100 g while said cavity is pressurized with said gaseous material, wherein the projectile forward section is configured or formed to expand upon impact and penetration with a target based on said gaseous material that exerts a force at or above 200 psi, said pressurized projectile is formed to expand laterally upon impact to increase said projectile's cross-sectional area upon impact based on force exerted by said gaseous material upon sides of said pressurized projectile, wherein said projectile has a sealable opening in a rear or side section of said projectile which further comprises a seal that is configured to be inserted after receiving said cryogenic material, said sealing is adapted to ensure said cavity retains said gas or fluid after it achieves said ambient temperature; and loading and firing said projectile from said projectile launcher towards said target using a launcher section that applies at least 100 g of force to said projectile.

43. A method as in claim 42 further comprising firing said projectile from said projectile launcher towards said target using a launcher section that applies at least 100 g of force to said projectile.

44. A method as in claim 43 wherein said projectile has said form factor based on a comparison with a G7 standard projectile resulting in a form factor calculation of less than 1.0.

45. A cryogenically pressurizable projectile adapted to at least partially laterally expand upon impact comprising:

an elongated body comprising a first, second, and third section, said second section is formed between said first and third sections, said first and third sections respectively have a first end and a second end section where said first end of said first section includes a forward tip of the projectile and said second end includes an aft end of said projectile on an opposing side of the elongated body from the forward tip, the elongated body having a first axis running through a center section of said first and second end sections as well as through a longitudinal center of said first, second and third sections, wherein said first section comprises an ogive shape rotated around said first axis;

an internal cavity disposed within said body with a side wall section surrounding and spaced apart from said first axis, wherein said internal cavity further is defined by a first and second cavity end section that are on opposing ends of said internal cavity adjacent to said side wall section, wherein said internal cavity is formed extending into said first and third sections and through said second section within said elongated body;

an internal cavity fill structure disposed through said second end section through a portion of said third section into said internal cavity;

a fill structure plug, screw, or closure section disposed within said fill structure adapted to receive and retain a cryogenic material into said internal cavity and retain structural integrity and remain fixed with respect to said second end section after said cryogenic materials generate a first internal gas upon thermal equalization within said projectile;

a gas at a pressure of at least 200 psi disposed within said cavity;

wherein said first internal gas pressure results in shear stress of at least 24,000 psi on a section of wall of the internal cavity;

wherein said internal cavity is formed such that it extends more than fifty percent of a radius line defined from said first axis to a plane-defined first cavity end section;

wherein said first section is formed with a wall section having a minimum thickness or rupture zone at or adjacent to a circular area of said first section parallel with and extending a first distance away from with said first cavity end section.

46. The projectile as in claim 45, wherein said projectile body comprises copper.

47. The projectile as in claim 45, wherein said ogive is formed having a rounded section.

48. The projectile as in claim 45, wherein said ogive is formed having a conical section.

49. The projectile as in claim 45, wherein said ogive is further formed with a meplat section defining said first end section.

50. The projectile as in claim 45, wherein said second end section is formed with a boattail form.

51. The projectile as in claim 45, wherein said elongated body's first section surrounding said cavity is formed having a solid structure.

52. The projectile as in claim 45, wherein said elongated body's first section at and between said forward tip and said internal cavity is formed with a solid structure.

53. The projectile as in claim 45, wherein said elongated body's first section at said first end section including said forward tip extending along said first axis comprises a hollow point or concave opening formed into said first end section.

* * * * *